US007503529B2

(12) United States Patent
Bartelsmeyer et al.

(10) Patent No.: US 7,503,529 B2
(45) Date of Patent: Mar. 17, 2009

(54) CLAMP ASSEMBLY FOR USE WITH ADJUSTABLE BED RAIL CROSS SUPPORT MEMBERS

(75) Inventors: Robert A. Bartelsmeyer, High Point, NC (US); David W. Stroud, Lexington, NC (US)

(73) Assignee: L&P Property Management Company, South Gate, CA (US)

( * ) Notice: Subject to any disclaimer, the term of this patent is extended or adjusted under 35 U.S.C. 154(b) by 307 days.

(21) Appl. No.: 11/617,299

(22) Filed: Dec. 28, 2006

(65) Prior Publication Data

US 2008/0155799 A1 Jul. 3, 2008

(51) Int. Cl.
*A47F 5/00* (2006.01)

(52) U.S. Cl. ..... 248/125.9; 5/207; 5/312; 248/354.3

(58) Field of Classification Search ..... 248/125.9, 248/121, 188.6, 188.8, 354.3; 5/200.1, 201, 5/203, 207, 310, 312
See application file for complete search history.

(56) References Cited

U.S. PATENT DOCUMENTS

| | | | | |
|---|---|---|---|---|
| RE24,392 | E | 11/1957 | Sten | |
| 3,761,970 | A | 10/1973 | Fredman | |
| 4,080,674 | A | 3/1978 | Fredman et al. | |
| 4,536,904 | A | 8/1985 | Whitehead | |
| 4,670,922 | A | 6/1987 | Mis | |
| 5,203,039 | A | 4/1993 | Fredman | |
| 5,502,852 | A | 4/1996 | Fredman et al. | |
| 5,894,614 | A | 4/1999 | Stroud | |
| 6,042,074 | A * | 3/2000 | Cusimano | 248/354.1 |
| 6,209,155 | B1 | 4/2001 | Epstein et al. | |
| 6,397,413 | B2 | 6/2002 | Epstein et al. | |
| 6,839,920 | B2 | 1/2005 | Schulte | |
| 7,231,676 | B2 * | 6/2007 | Cloer et al. | 5/310 |
| 7,363,666 | B2 * | 4/2008 | Polevoy et al. | 5/311 |

* cited by examiner

*Primary Examiner*—J. Allen Shriver, II
*Assistant Examiner*—Bradley H Duckworth
(74) *Attorney, Agent, or Firm*—Wood, Herron & Evans, LLP

(57) ABSTRACT

A clamp assembly for securing a pair of overlapping cross support members extending between two opposed side rails of a bed frame is provided. The clamp assembly includes a unitary clamp body, a leg assembly pivotally secured to the clamp body and a locking plate pivotally secured to the clamp body. In order to prevent the cross support members from sliding relative to one another, the leg assembly exerts force on the overlapping cross support members. The leg assembly may comprise a first leg pivotally secured to the clamp body, a plastic insert and a foot member. Alternatively, the leg assembly may comprise a first leg nestably secured to a second leg in order to increase the length of the leg assembly.

15 Claims, 6 Drawing Sheets

CLAMP ASSEMBLY FOR USE WITH ADJUSTABLE BED RAIL CROSS SUPPORT MEMBERS

FIELD OF INVENTION

This invention relates to bed frames having two opposed side rails connecting a headboard and a footboard and, more particularly, to a clamp assembly for securing overlapping cross support members adapted to be secured to the side rails of such a bed frame.

BACKGROUND OF THE INVENTION

A conventional bed frame has two opposed side rails extending between a footboard and a headboard. These side rails may be made of any material but are most often made of metal or wood. The side rails often have a flat horizontal flange extending inwardly from a vertical portion. In order to support the weight of a box spring and mattress, a plurality of transversely extending wooden or metal slats often were inserted between the side rails and rested on the horizontal flanges of the side rails. However, such transversely extending slats often warped, twisted outwardly or deflected under the weight of the box spring and mattress placed on top of the rails. As wider span-size beds such as a queen size bed which is 60" standard width or a king size bed which is 76" standard width became more popular, the wooden slats had to become longer and wider. The problem of twisting or torquing slats increased and in addition, the two opposed side rails tended to twist or turn outwardly as well due to the weight placed on the slats.

U.S. Pat. No. 4,080,674 discloses a center cross bar extending transversely of two opposed side bed rails which eliminates the need for transversely extending slats. The center cross bar is provided with two vertically adjustable supporting leg assemblies, each leg assembly having a vertically adjustable glide or foot at the lower end thereof. The glides contact a floor or other supporting surface to support the cross bar so as to prevent sagging of a box spring placed thereon and prevent any vertical deflection, horizontal deflection and twisting or torquing of the opposed side rails of the bed frame. Such a vertically adjustable supporting leg assembly incorporated into a cross bar enabled the two opposed bed rails or side rails to be pulled into a snug engagement with a box spring over a substantial portion of the length of the box spring in order to provide a firm support for the box spring along the bottom side and center portion of the box spring without having to utilize transversely extending removable slats.

U.S. Pat. No. 5,203,039 discloses a cross bar adjustable in length as well as height adapted to extend between two wooden side rails of a bed frame. The cross bar has multiple legs which are pivotally connected to the cross bar and capable of pivoting upwardly into a nesting relation with the cross bar for ease of packaging and/or shipping. The legs are also capable of being pivoted downwardly and secured in an erect position. In addition, this patent discloses a cross bar which is adjustable in length because the cross bar comprises two nestable sections each comprising an "L" shaped angle iron. The sections may be pulled apart to increase the length of the cross bar to fit a king or queen size bed and an overlapped, nested portion of the sections secured with a clamp and thumb screw.

U.S. Pat. Nos. 6,209,155 and 6,397,413 each disclose adjustable or extensible cross bars or members for bed rails and frames similar to the adjustable cross bars disclosed in U.S. Pat. No. 5,203,039. Like the cross bars disclosed in U.S. Pat. No. 5,203,039, the cross bars disclosed in U.S. Pat. Nos. 6,209,155 and 6,397,413 are adjustable in length. Each cross bar comprises two pieces, each piece having an L-shaped cross-sectional configuration. The pieces or members of each cross bar are joined in an overlapped or nested region with a clamping member. Each piece or member has a leg which can be adjusted in order to change the height of the cross bar relative to the supporting surface or floor.

The clamping member disclosed in U.S. Pat. No. 5,203,039 uses a thumb screw which passes through a threaded opening in the clamping member to secure the overlapping members together. Use of a clamping member like the one disclosed in U.S. Pat. No. 5,203,039, may allow the angle iron pieces to slide or move laterally undesirably or possibly even separate from each other if the thumb screw becomes loose over time.

The clamping member disclosed in U.S. Pat. Nos. 6,209,155 and 6,397,413 uses lances which engage openings in the angle iron pieces or cross member pieces to lock the clamp and pieces together. Such a clamping member makes separating the pieces of angle iron difficult and may require the use of a special tool to separate the pieces to move the bed. The manufacture of such a clamping member may be expensive due to the formation of the lances.

Typically, each of the pieces or cross members has a leg which may be adjustable in height, as shown in U.S. Pat. No. 6,209,155. However, clamping members used to secure the overlapping portions of the angle iron pieces of each cross bar have been known to have a downwardly depending leg. U.S. Pat. Nos. 6,839,920 and 6,397,413 disclose such clamping members. One difficulty with each of these clamping members is that the leg is fixed in a down position relative to the remainder of the clamping member with rivets or welds. Thus, the leg is not able to be folded into a up position for shipping or other purposes.

Therefore, there is a need for a clamp assembly having a movable leg which keeps the overlapped cross members from slipping or moving relative to each other.

SUMMARY OF THE INVENTION

The invention of the application which accomplishes these objectives comprises a clamp assembly for securing together a pair of overlapping cross support members extending between two opposed side rails of a bed frame. The clamp assembly may be used in other environments, such as for example, in a bed frame center support assembly like that disclosed in U.S. Pat. No. 5,894,614.

The clamp assembly comprises a clamp body, a leg assembly pivotally secured to the clamp body and a locking plate pivotally secured to the clamp body. The unitary clamp body has a top portion, a rear portion extending downwardly from the top portion, a bottom portion and a front portion extending upwardly from the bottom portion.

The leg assembly comprises a first leg pivotally secured to the front portion of the clamp body. The first leg has two coplanar flanges separated by a longitudinally extending groove and a bracket integrally formed in the end of the first leg remote from its pivotal connection to the clamp body. The bracket has a circular opening therethrough of a fixed diameter.

A plastic insert is adapted to fit inside the circular opening of the bracket. The plastic insert has a cylindrical body portion and a flange at one end of the body portion. The flange has a diameter greater than the fixed diameter of the circular opening. The plastic insert has a threaded thoroughbore extending through the body portion and the flange.

The leg assembly further includes a foot member having a threaded stem. The threaded stem is adapted to engage the threaded thoroughbore of the plastic insert when the plastic insert is placed inside the circular opening of the bracket. The foot member enables the leg assembly to have an adjustable height so that the distance from the foot member to the side rails of the bed frame can be adjusted by threading the threaded stem through the threaded thoroughbore of the plastic insert. A wing nut is located underneath the plastic insert. The wing nut may be tightened in order to fix the height of the leg assembly.

If a longer leg assembly is desired, a second leg may be secured to the first leg of the leg assembly. The second leg may have a longitudinal dimension greater than the longitudinal dimension of the first leg. However, the second leg may be identically configured to the first leg, the second leg having two coplanar flanges and a longitudinally extending groove located between the flanges. The second leg also has a bracket integrally formed in the end of the second leg remote from its connection to the first leg. The bracket has a circular opening therethrough like the bracket of the first leg. The second leg and the first leg may be nestably connected with a fastener such that the bracket of the first leg resides in the groove of the second leg, the second leg being underneath the first leg. The legs are connected by one or more fasteners passing through holes formed in the nested grooves of the legs.

Like the first leg, the bracket formed in the second leg is adapted to receive a plastic insert. The plastic insert is the same as that described hereinabove and comprises a body portion and a flange at one end of the body portion. The flange has a greater diameter than the fixed diameter of the body portion so as to prevent the plastic insert from passing through the circular opening of the bracket of either leg. A foot member having a threaded stem may engage the plastic insert making the leg assembly vertically adjustable. The ability of the leg assembly to comprise multiple members nested within one another enables the height of the leg assembly to be increased without decreasing the stability of the leg assembly.

The locking plate is pivotally secured to the top portion of the clamp body and is used to lock the leg assembly in a down locked position. The locking plate is adapted to be received in a slot in the first leg of the leg assembly. The locking plate has a front lip which enables a person to easily move or pivot the locking plate between a first position in which the locking plate is located in the slot of the leg assembly and a second position in which the locking plate is spaced away from the slot.

These and other objects and advantages of this invention will be readily apparent from the following description of the drawings.

DETAILED DESCRIPTION OF THE DRAWINGS

Figure 1:
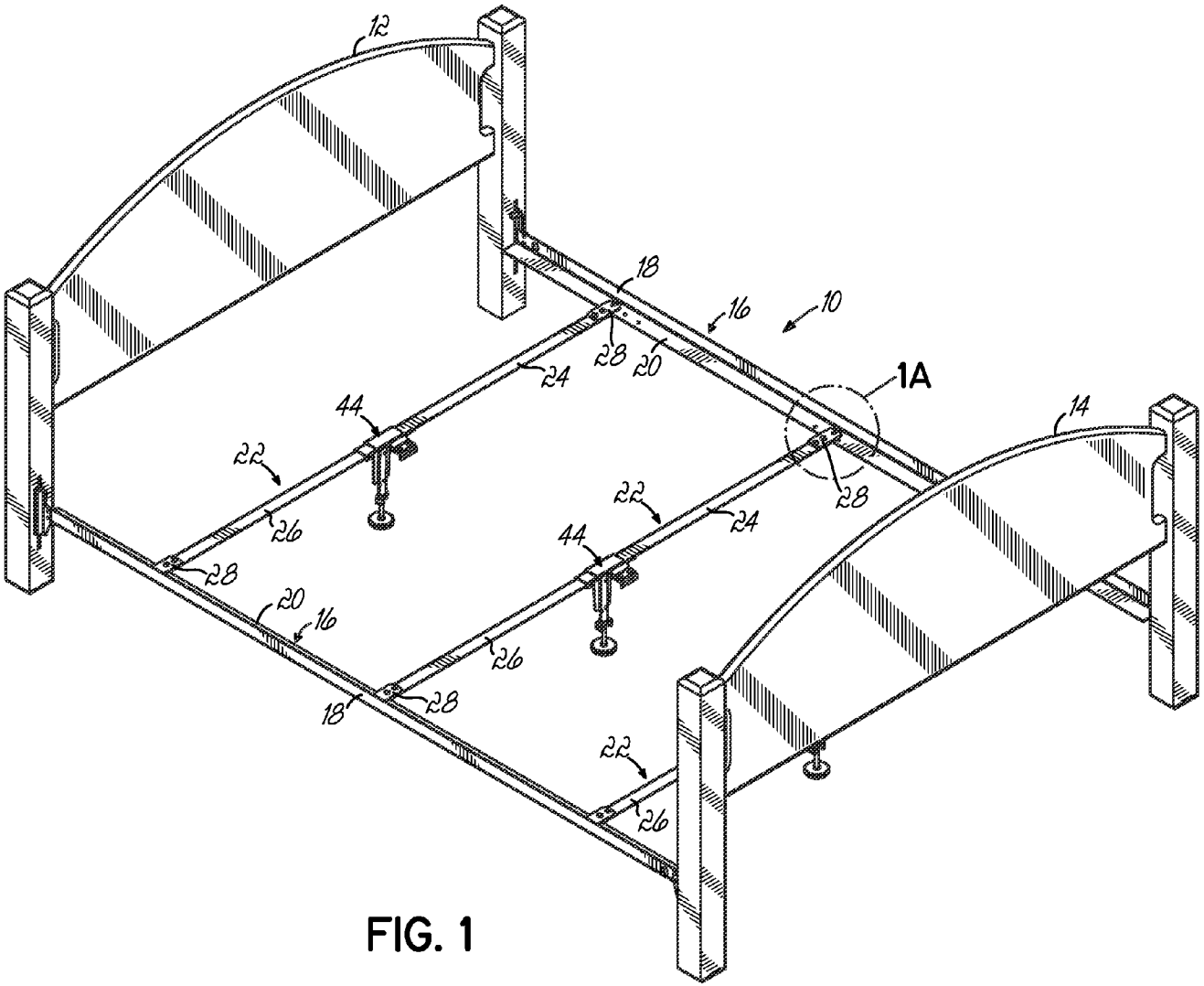
FIG. 1 is a perspective view of three clamp assemblies of the present invention being uses to secure three sets of overlapping cross support members, the cross support members being secured to side rails of a conventional bed frame.

Referring to the drawings and particularly to FIG. 1, there is illustrated a bed frame 10 comprising a headboard 12, a footboard 14 and two opposed side rails 16. The headboard 12 and footboard 14 of the bed frame 10 are typically made of wood but may alternatively be made of other materials such as metal. Each side rail 16 has a vertical portion or flange 18 and a horizontal portion or flange 20, the horizontal flange 20 extending inwardly from the lowermost edge of the vertical flange 18.

Figure 1A:
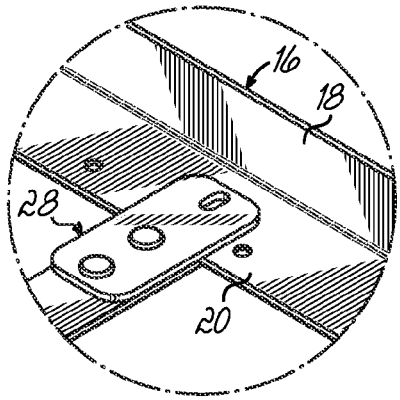
FIG. 1A is an enlarged perspective view of the encircled area 1A of FIG. 1.

Three support bars 22 are located generally inside the bed frame between the two opposed side rails 16 and between the headboard 12 and the footboard 14. Each support bar 22 comprises a pair of overlapping cross support members 24, 26. Cross support member 24 is secured to one of the side rails 16 and cross support member 24 is secured to the opposite side rail 16. The cross support members 24, 26 extend between the two side rails 16 of the bed frame 10 and are secured at their ends to the horizontal flanges 20 of the side rails 16 in any conventional manner such as with brackets 28 as shown in FIG. 1A.

Figure 2A:
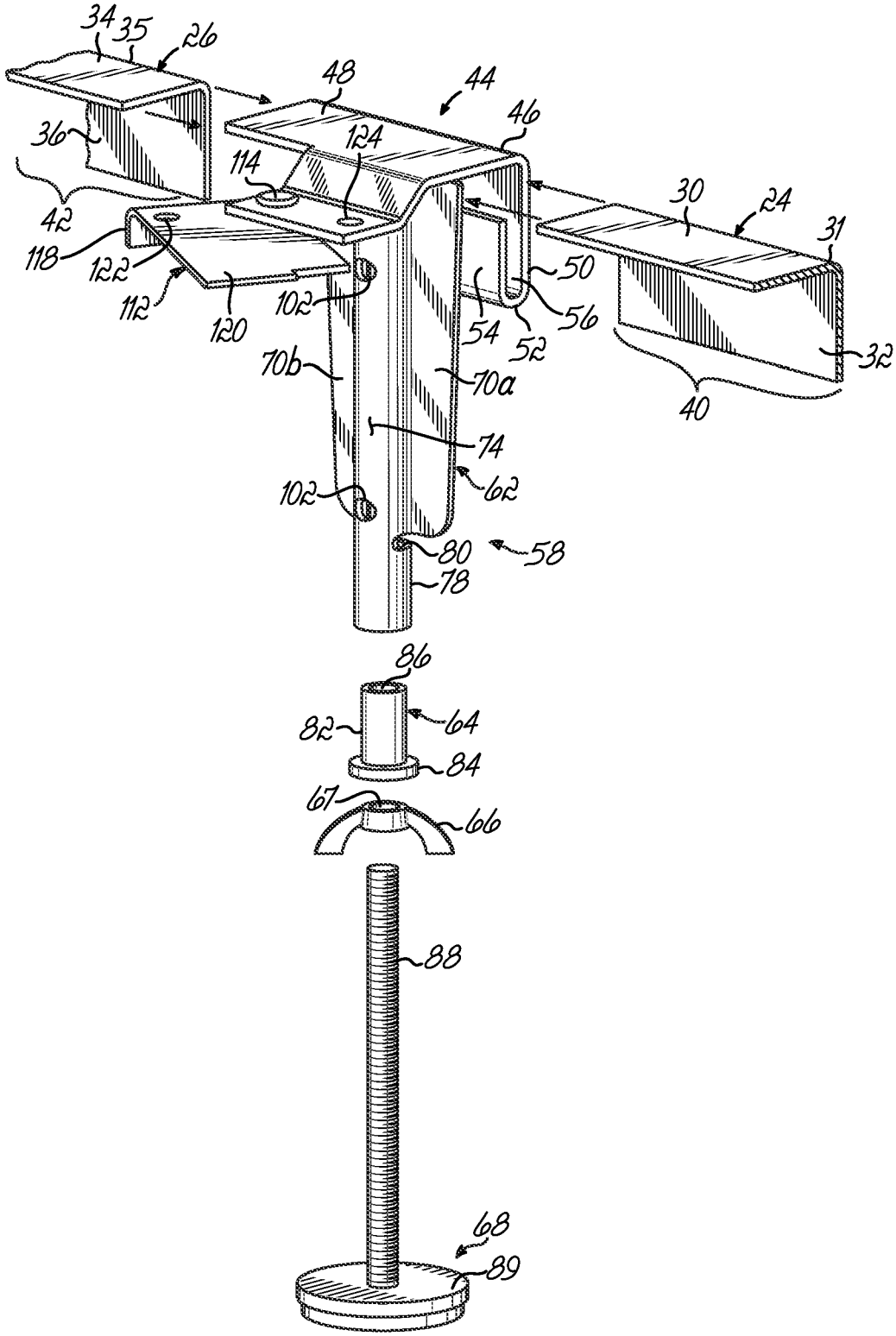
FIG. 2A is a partially exploded perspective view of the clamp assembly of the present invention.
Figure 2B:
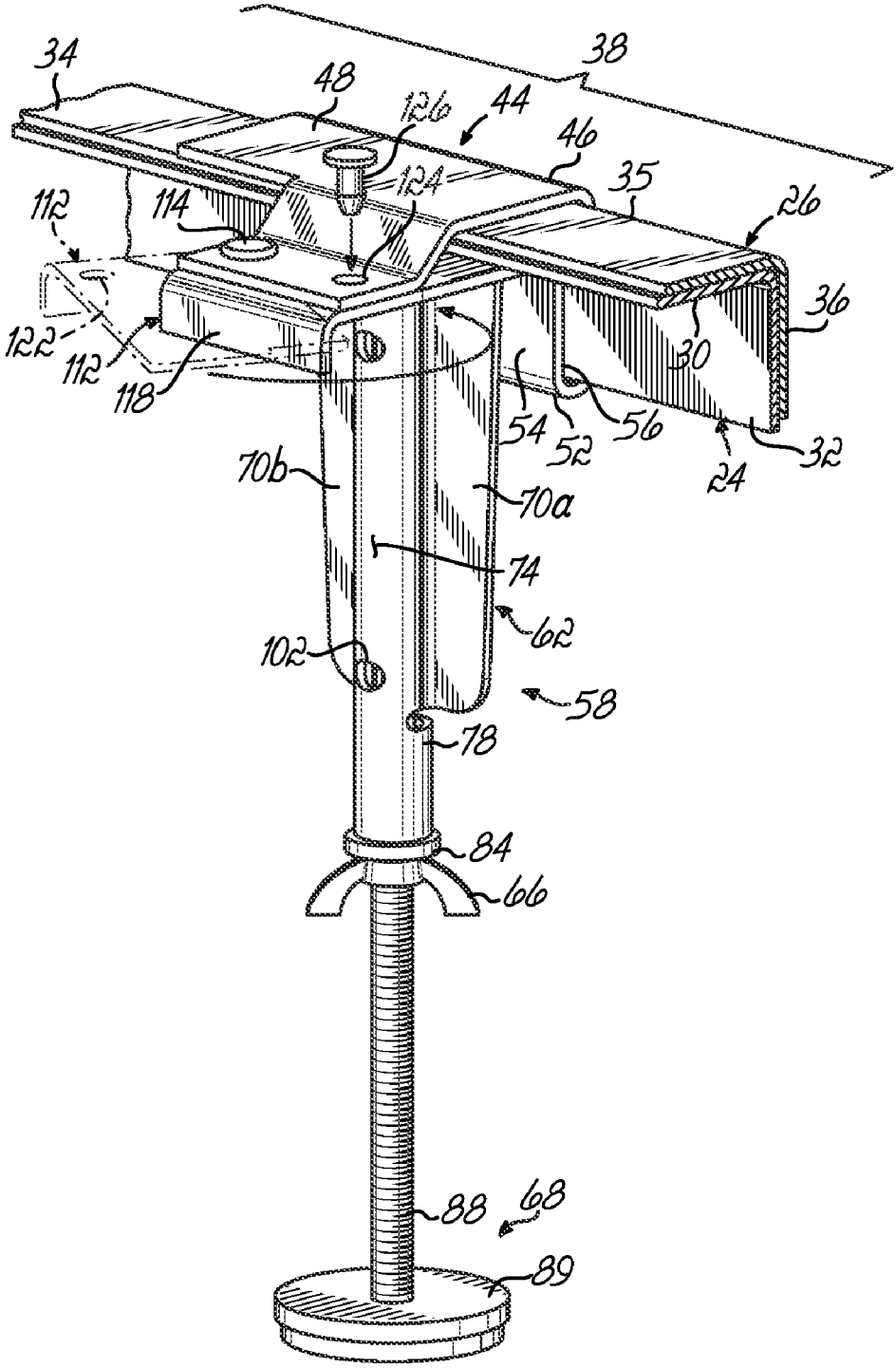
FIG. 2B is a perspective view of the clamp assembly of FIG. 2A assembled.

As best illustrated in FIG. 2A, each cross support member 24 has a horizontal web 30 and a vertical web 32, the vertical web 32 extending downwardly from the outside edge 31 of the horizontal web 30. Likewise, each cross support member 26 has a horizontal web 34 and a vertical web 36, the vertical web 36 extending downwardly from the outside edge 35 of the horizontal web 34. Each of the cross support members 24, 26 therefore has an "L" shaped cross-sectional configuration. As illustrated in FIG. 2B, each cross support bar 22 comprises overlapping nested "L" angle cross support members 24, 26 which overlap in an overlapping region 38.

As illustrated in FIG. 2B, the first and second cross support members 24, 26 have an overlapped portion 38. In the overlapped portion 38, a central portion 40 of the first cross support member 24 overlaps with a central portion 42 of the second cross support member 26 with the central portions 40, 42 nested inside one another. The drawings illustrate the first cross support member 24 being nested inside the second cross support member 26 but the reverse may also occur with the second cross support member 26 being nested inside the first cross support member 24

As illustrated in FIGS. 2A and 2B, a clamp assembly 44. secures the central portions 40, 42 of the first and second cross support members 24, 26, respectively together in a nested relationship. The clamp assembly 44 comprises a clamp body 46 which is shown as a unitary member but may be multiple members. Clamp body 46 comprises a top portion 48, a rear portion 50 which extends downwardly from the back of the top portion 48, a bottom portion 52 which is illustrated as being curved but may be any desired shape, and a front portion 54 extending upwardly from a front edge of the bottom portion 52. The front portion 54, bottom portion 52 and rear portion 50 of the clamp body 46 define a generally U-shaped receptacle 56 for receiving and retaining the overlapped vertical flanges or webs 32, 36 of the cross support members 24, 26, respectively. Likewise, the top portion 48 of the clamp body 46 provides a ceiling preventing upward movement of the overlapped webs 30, 34 of the cross support members 24, 26, respectively.

Figure 3A:
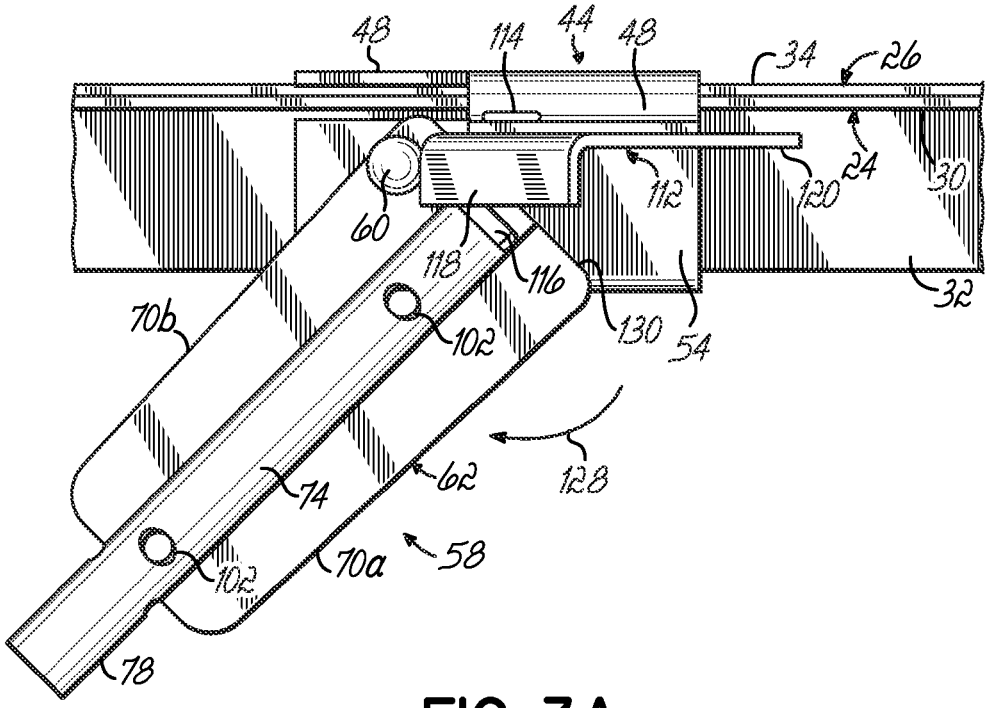
FIG. 3A is a front elevational view of the clamp assembly of FIG. 2A, one embodiment of the leg assembly being pivoted in an up position.

As best illustrated in FIGS. 2A, 2B, 3A and 3B, the clamp assembly 44 further comprises a leg assembly 58 pivotally secured to the front portion 54 of the clamp body 46. A fastener 60, such as a rivet, secures the leg assembly 58 to the front portion 54 of the clamp body 46, as illustrated in FIG. 3A.

The leg assembly 58 may take on alternative configurations using a relatively few number of parts. One embodiment of the leg assembly 58 illustrated in FIG. 2A comprises a first leg 62, a plastic insert 64, a wing nut 66 and a foot member 68. The first leg 62 has two coplanar flanges 70*a*, 70*b* separated by a longitudinally extending groove 72. Groove 72 has a convex outer surface 74 and a concave inner surface 76. The lower portions of the flanges 70*a*, 70*b* are wrapped around each other so as to form a bracket 78. The bracket 78 is integrally formed in the end of the first leg 62 remote from the first leg's pivotal connection to the front portion 54 of the clamp body 46. The bracket 78 has a circular opening 80 therethrough of a fixed diameter. The opening 80 is circular in cross section.

As best illustrated in FIGS. 2A and 2B, the plastic insert 64 is adapted to fit inside the circular opening 80 of the bracket 78. As seen in FIG. 2A, the plastic insert 64 has a cylindrical body portion 82 and a flange 84 at one end of the body portion. The flange 84 has an outer diameter greater than the outer diameter of the body portion 82 of the plastic insert 64 so as to prevent the plastic insert 64 from passing through the circular opening 80 of the bracket 78. The plastic insert 64 has a threaded throughbore 86 extending through the body portion 82 and the flange 84.

The leg assembly 58 further comprises a foot member 68 having a threaded stem 88 and a circular bottom 89. The threaded stem 88 extends upwardly from the circular bottom 89 of the foot member 68 and is adapted to engage the threaded throughbore 86 of the plastic insert 64 so as to provide an adjustable leg assembly in which the distance from the bottom of the foot member 68 to the cross support members 24, 26 can be adjusted by threading the stem 88 through the threaded throughbore 86 of the plastic insert 64. A wing nut 66 having a threaded interior hole 67 therethrough is adapted to engage the threaded stem 88 below the plastic insert 64 so that by rotating the wing nut 66, the height of the foot member 68 will be fixed until the wing nut is loosened.

Figure 5A:
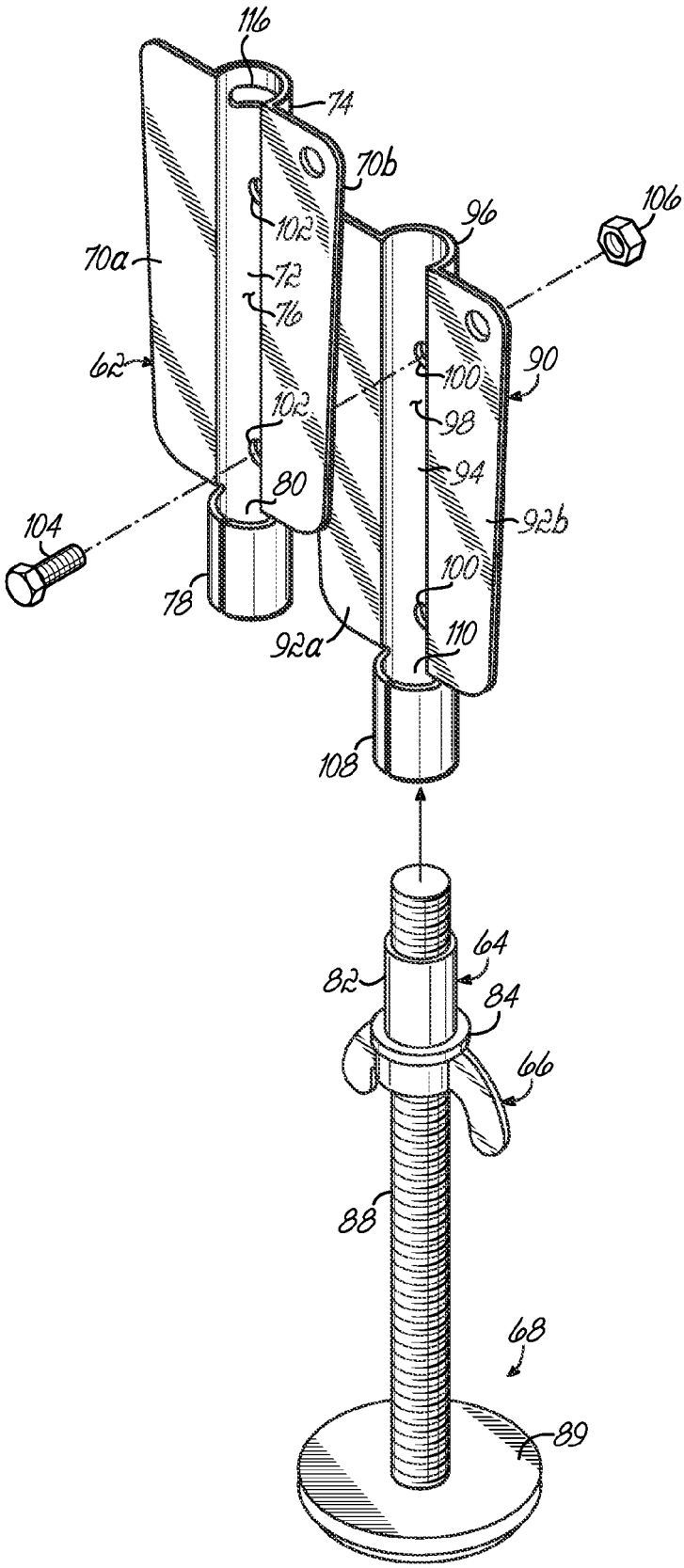
FIG. 5A is an exploded perspective view of an alternative embodiment of the leg assembly comprising a first leg secured to a the clamp body, a second leg, a plastic insert, and an adjustable foot member.
Figure 5B:
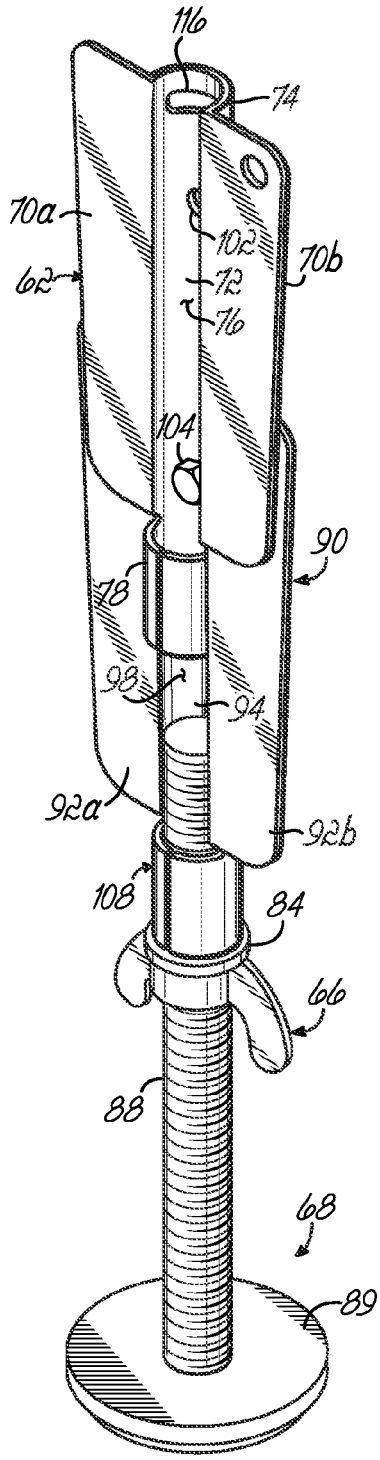
FIG. 5B is a perspective view of the leg assembly of FIG. 5A when assembled.

As illustrated in FIGS. 5A and 5B, the leg assembly 58 may further comprise a second leg 90 similarly cross-sectionally configured to that of the first leg 62, i.e. having two outer flanges 92*a*, 92*b* separated by a longitudinally extending groove 94. Groove 94 has a convex outer surface 96 and a concave inner surface 98. The longitudinal dimension of the second leg 90 may or may not be longer than that of the first leg 62. Holes 100 are located through the groove 94 in the second leg 90 as illustrated in FIG. 5A. Similarly, holes 102 are located in the groove 72 of the first leg 62 so that the length of the leg assembly may be increased by aligning the holes 100, 102 and passing a fastener 104 therethrough. The threaded fastener 104 may engage a nut 106 in order to secure the top of the second leg 90 to the bottom of the first leg 62. The bracket 78 of the first leg 62 nests inside the groove 94 of the second leg, as best illustrated in FIG. 5B.

Like the first leg, the second leg 90 has a bracket 108 integrally formed from the flanges 92*a*, 92*b* of the second leg 90. The flanges 92*a*, 92*b* are wrapped around toward each other so as to define a circular opening 110. The circular opening 110 of the bracket 108 of the second leg 90 is approximately the same diameter as the diameter of the circular opening 80 of the bracket 78 formed in the first leg 62. As illustrated in FIG. 5A, the plastic insert 64 may be inserted into the circular opening 110 of the bracket 108 and the threaded stem 88 of the foot member 68 screwed into the threads of the plastic insert 64. A wing nut 66 may be located between the plastic insert 64 and the bottom 89 of the foot member 68. The wing nut 66 may be tightened in order to fix the length of the leg assembly.

The leg assembly 58 of the present invention is pivotally secured to the front portion 54 of the clamp body 46 and may be locked in a downward locked position by a locking plate 112. The leg assembly 58 may comprise solely a first leg 62 as illustrated in FIGS. 2A and 2B adapted to engage a threaded foot member or the leg assembly 58 may comprise a first leg 62 and a second leg 90, the second leg 90 being adapted to receive a threaded foot member 68. In this fashion, the length of the leg assembly can be increased more than heretofore known leg assemblies thus enabling the side rails to be higher off the ground or supporting surface than heretofore possible.

Figure 4:
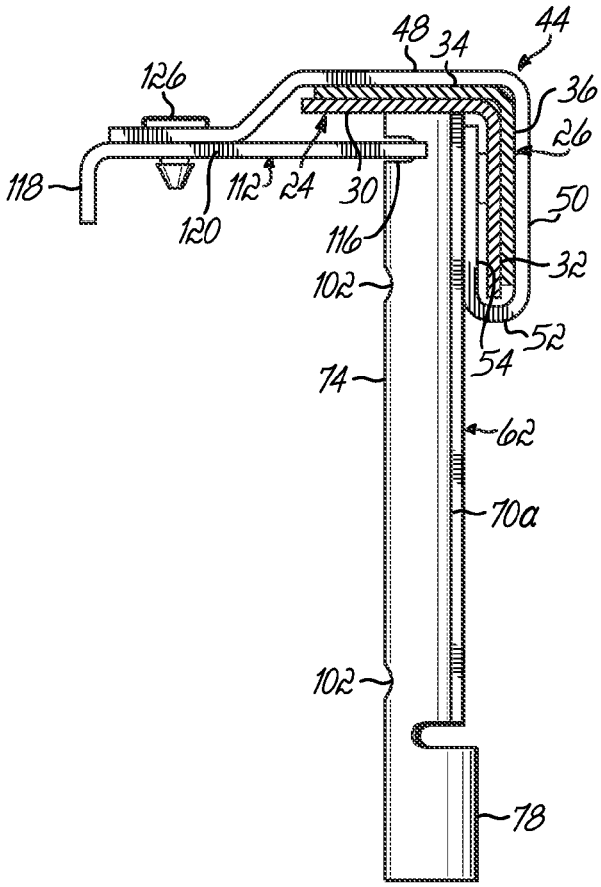
FIG. 4 is a side elevational view, partially in cross-section, of the clamp assembly of FIG. 3A being used, the leg assembly being locked in a down position.
Figure 3B:
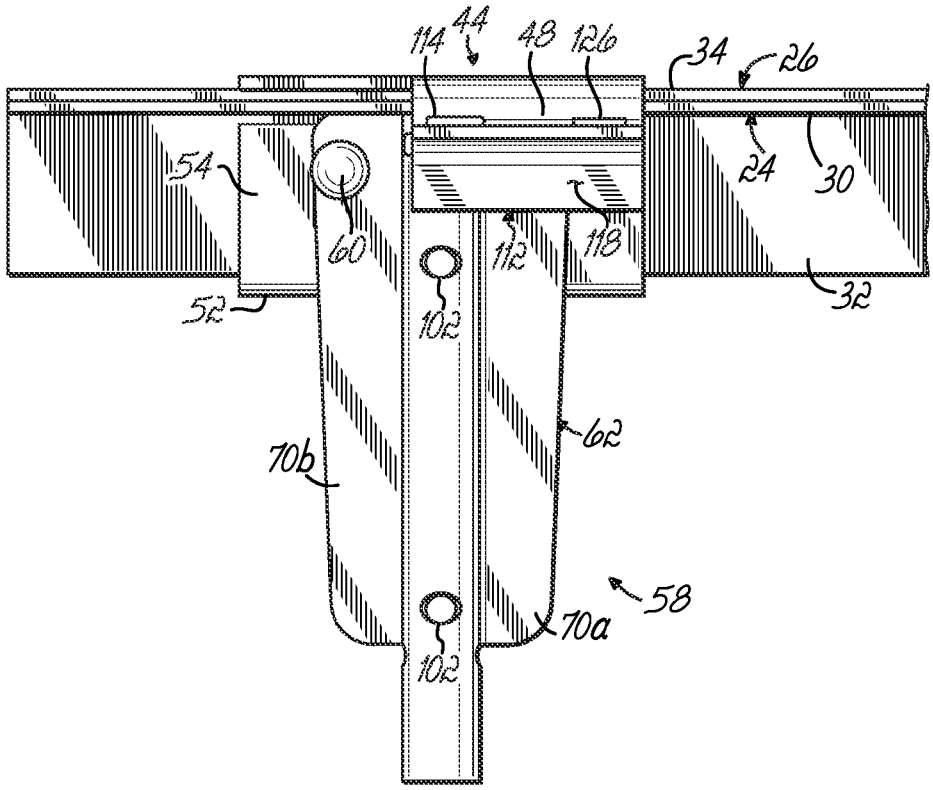
FIG. 3B is a front elevational view of the clamp assembly of FIG. 2A, the leg assembly being locked in a down position.

As shown in FIGS. 2A and 2B, the locking plate 112 is pivotally secured to the top portion 48 of the clamp body 46 via a rivet 114. The locking plate 112 is movable between a first position shown in FIGS. 2B and 4 in which the locking plate 112 is received in a slot 116 in the first leg 62 of the leg assembly 58, thereby locking the leg assembly 58 in a down locked position as shown in FIG. 3B and a second position shown in FIG. 2A in which the locking plate 112 is not located in the slot 116, thereby allowing the leg assembly 58 to pivot upwardly to a collapsed position shown in FIG. 3A. The slot 116 extends through an upper portion of the groove 74 of the first leg 62, as shown in FIG. 4. In order to help move the locking plate 112 between positions, the locking plate 112 has a vertically oriented handle portion 118 extending downwardly from the front of a generally planar body portion 120. As illustrated in FIG. 4, the locking plate 112 has an "L-shaped" cross-sectional configuration.

As shown in FIG. 2A, a hole 122 is formed through the body portion 120 of the locking plate 112. When the locking plate 112 is pivoted or moved to its first position shown in FIG. 2B, this hole 122 lines up with a hole 124 through the top portion 48 of the clamp body 46. See FIG. 2A. In order to secure the leg assembly 58 in a down locked position, a second fastener 126, such as a rivet 126, may be passed through the aligned holes 122, 124. By removing fastener 126, the leg assembly 58 can be pivoted upwardly in the direction of arrow 128 (see FIG. 3A) Once the fastener 126 is inserted and secured, the leg assembly 58 is locked in a down-locked position.

When the leg assembly 58 is moved from its first raised position shown in FIG. 3A to its second lowered locked position shown in FIG. 3B, the upper edge 130 of the first leg 62 presses against the nested overlapped cross support members 24, 26, thereby preventing the overlapped cross support members 24, 26 from slipping or moving relative to one another. This frictional engagement is maintained while the locking plate 112 engages the slot 116 in the first leg 62.

While we have described several preferred embodiments of the clamp assembly, persons skilled in the art will appreciate changes and modifications which may be made to the clamp assembly without departing from the spirit of the invention of this application. Therefore, we intend to be limited only by the scope of the following appended claims.

We claim:

1. A clamp assembly for securing overlapping cross support members extending between two opposed side rails of a bed frame, said clamp assembly comprising:

a clamp body comprising a top portion, a rear portion extending downwardly from said top portion, a bottom portion and a front portion extending upwardly from said bottom portion, a leg assembly pivotally secured to said front portion of said clamp body, said leg assembly comprising a first leg pivotally secured to said front portion of said body, said first leg having two coplanar flanges, a groove extending longitudinally between the flanges and a bracket integrally formed in the end of the first leg remote from its pivotal connection to front portion of the body, said bracket having a opening therethrough, and a locking plate pivotally secured to said clamp body, said locking plate being adapted to be received in a slot in said first leg for locking said leg assembly in a down position, wherein said leg assembly is locked in a down position by a fastener extending through a hole in the locking plate and a hole in the clamp body.

2. The clamp assembly of claim 1 further comprising a plastic insert adapted to fit inside said opening, said plastic insert having a body portion and a flange at one end of the body portion, said plastic insert having a threaded throughbore extending through said body portion and said flange, and a foot member having a threaded stem, said threaded stem being adapted to engage the threaded throughbore of the plastic insert to provide an adjustable leg in which the distance from the foot member to the cross support members can be adjusted by threading the stem through the threaded throughbore.

3. The clamp assembly of claim 1 wherein said clamp body is a unitary member.

4. The clamp assembly of claim 1 wherein said locking plate is riveted to said top portion of said clamp body.

5. The clamp assembly of claim 1 further comprising a second leg, said second leg being secured to the first leg of said leg assembly, said second leg having two coplanar flanges, a longitudinally extending groove between the flanges and a bracket integrally formed from the end of the second leg remote from its connection to the first leg, said bracket having an opening therethrough, said second leg being nested with said first leg such that said bracket of said first leg resides in said groove of said second leg and said legs are connected by at least one fastener passing through the nested grooves of the legs.

6. The clamp assembly of claim 5 further comprising:

a plastic insert comprising a body member adapted to fit in the opening in the bracket of the second leg, said body member having a flange larger than the opening at one end of the body member and a threaded throughbore extending through said body member, and a foot member having a threaded stem extending outwardly therefrom and being adapted to engage the threaded throughbore of the plastic insert to provide an adjustable leg in which the distance from the foot member to the cross rails of the bed frame can be adjusted by threading the stem through the threaded throughbore.

7. A clamp assembly for securing overlapping cross support members extending between two opposed side rails of a bed frame, said clamp assembly comprising:

a clamp body comprising a top portion, a rear portion extending downwardly from said top portion, a bottom portion and a front portion extending upwardly from said bottom portion, a leg assembly pivotally secured to said clamp body, a locking plate pivotally secured to said clamp body, said locking plate being adapted to be received in a slot in said leg assembly for locking said leg in a down position, said locking plate having a hole therethrough adapted to receive a fastener for securing the leg assembly in a down locked position.

8. The clamp assembly of claim 7, said leg assembly comprising a first leg pivotally secured to said front portion of said clamp body, said first leg having two coplanar flanges, a groove extending longitudinally between the flanges and a bracket integrally formed in the end of the first leg remote from its pivotal connection to the front portion of said clamp body, said bracket having an opening therethrough.

9. The clamp assembly of claim 8 further comprising:

a plastic insert comprising a body member adapted to fit in the opening, said body member having a flange larger than the opening at one end of the body member and a threaded throughbore extending through said body member, and a foot member having a threaded stem extending outwardly therefrom and being adapted to engage the threaded throughbore of the plastic insert to provide an adjustable leg in which the distance from the foot member to the cross rails of the bed frame can be adjusted by threading the stem through the threaded through bore.

10. The clamp assembly of claim 9 further comprising a second leg, said second leg being secured to the first leg of each leg assembly, said second leg having two coplanar flanges, a longitudinally extending groove between the flanges and a bracket integrally formed in the end of the second leg remote from its connection to the first leg, said bracket having an opening therethrough, said second leg being nested with said first leg such that said bracket of said first leg resides in said groove of said second leg and said legs are connected by at least one fastener passing through the nested grooves of the legs.

11. The clamp assembly of claim 10 further comprising:

a plastic insert comprising a body member adapted to fit in the opening in the bracket of the second leg, said body member having a flange larger than the opening at one end of the body member and a threaded throughbore extending through said body member, and a foot having a threaded stem extending outwardly therefrom and being adapted to engage the threaded throughbore of the plastic insert to provide an adjustable leg in which the distance from the foot to the cross rails of the bed frame can be adjusted by threading the stem through the threaded throughbore.

12. A clamp assembly for securing overlapping cross support members extending between two opposed side rails of a bed frame, said clamp assembly comprising:

a clamp body having a generally U-shaped receptacle for receiving vertically oriented flanges of the cross support members;

a leg assembly pivotally secured to said clamp body, said leg assembly comprising a first leg pivotally secured to said front portion of said body, said first leg having two coplanar flanges, a groove extending longitudinally between the flanges and a bracket integrally formed in the end of the first leg remote from its pivotal connection to said clamp body, said bracket having an opening therethrough, and a locking plate pivotally secured to said clamp body, said locking plate being movable between a first position in which said locking plate is received in a slot in said leg assembly and a second position in which said locking plate is not in said slot, wherein said leg assembly is locked in a down position by a fastener extending through a hole in the locking plate and a hole in the clamp body.

13. The clamp assembly of claim 12 further comprising a plastic insert adapted to fit inside said opening, said plastic insert having a cylindrical body portion and a flange at one end of the body portion, said plastic insert having a threaded throughbore extending through said body portion and said flange, and a foot member having a threaded stem, said threaded stem being adapted to engage the threaded throughbore of the plastic insert to provide an adjustable leg in which the distance from the foot member to the cross members can be adjusted by threading the stem through the threaded throughbore.

14. The clamp assembly of claim 12 wherein said clamp body is a unitary member.

15. The clamp assembly of claim 12 wherein said locking plate is riveted to a top portion of said clamp body.

* * * * *

UNITED STATES PATENT AND TRADEMARK OFFICE

CERTIFICATE OF CORRECTION

PATENT NO. : 7,503,529 B2
APPLICATION NO. : 11/617299
DATED : March 17, 2009
INVENTOR(S) : Robert A. Bartelsmeyer et al.

It is certified that error appears in the above-identified patent and that said Letters Patent is hereby corrected as shown below:

Column 2
Line 36, "into a up" should be --into an up--.

Column 3
Line 58, "being uses" should be --being used--.

Column 4
Line 11, "secured to a the" should be --secured to the--.
Line 58, insert a --.-- after "member 24".
Line 59, delete the "." after "44".

Column 6
Line 54, insert a --.-- after "(see FIG. 3A)".

Column 7
Line 20, "having a opening" should be --having an opening--.

Column 8
Line 30, "through bore" should be --throughbore--.

Signed and Sealed this

Eighteenth Day of August, 2009

David J. Kappos

David J. Kappos
*Director of the United States Patent and Trademark Office*